United States Patent [19]

Mitsuyasu et al.

[11] Patent Number: 4,909,440

[45] Date of Patent: Mar. 20, 1990

[54] FUEL INJECTOR FOR AN ENGINE

[75] Inventors: Masaki Mitsuyasu; Eiji Hashimoto, both of Susono, Japan

[73] Assignee: Toyota Jidosha Kabushiki Kaisha, Japan

[21] Appl. No.: 267,253

[22] Filed: Nov. 4, 1988

[30] Foreign Application Priority Data

Jan. 21, 1988 [JP] Japan ..... 63-009644

[51] Int. Cl.[4] ..... F02M 61/20

[52] U.S. Cl. ..... 239/96; 239/533.8; 239/533.9; 123/467; 251/129.07; 310/328

[58] Field of Search ..... 239/102.2, 533.8, 533.1, 239/533.2, 533.9, 96; 251/129.06, 129.07, 57; 310/328; 123/498, 467, 478, 494

[56] References Cited

U.S. PATENT DOCUMENTS

| | | | |
|---|---|---|---|
| 3,598,506 | 8/1971 | O'Neill | 310/328 |
| 4,535,743 | 8/1985 | Igashira et al. . | |
| 4,553,059 | 11/1985 | Abe et al. | 310/328 |
| 4,579,283 | 4/1986 | Igashira et al. | 239/102.2 |
| 4,688,536 | 8/1987 | Mitsuyasu et al. | 310/317 |
| 4,725,002 | 2/1988 | Trachte | 239/102.2 |
| 4,732,129 | 3/1988 | Takigawa et al. | 239/102.2 |
| 4,750,706 | 6/1988 | Schlagmuller | 239/102.2 |
| 4,762,300 | 8/1988 | Inagaki et al. | 251/129.06 |
| 4,784,102 | 11/1988 | Igashira et al. | 123/498 |
| 4,803,393 | 2/1989 | Takahashi | 239/533.1 |

FOREIGN PATENT DOCUMENTS

| | | | |
|---|---|---|---|
| 2704688 | 8/1977 | Fed. Rep. of Germany | 239/533.8 |
| 3414378 | 10/1984 | Fed. Rep. of Germany . | |
| 59-206668 | 11/1984 | Japan . | |
| 0206671 | 11/1984 | Japan | 239/102.2 |
| 59-231170 | 12/1984 | Japan . | |
| 60-1369 | 1/1985 | Japan . | |
| 60-19968 | 2/1985 | Japan . | |
| 60-53660 | 3/1985 | Japan . | |
| 60-104762 | 6/1985 | Japan . | |
| 62-3166 | 1/1987 | Japan . | |
| 62-31767 | 2/1987 | Japan . | |
| 62-31768 | 2/1987 | Japan . | |
| 63-65167 | 3/1988 | Japan . | |

OTHER PUBLICATIONS

Copending U.S. patent application No. 84557 filing date '87 8/12, now U.S. Pat. No. 4,782,807.

Copending U.S. patent application No. 73155, filing date '87 7/14, now U.S. Pat. No. 4,803,393.

Copening U.S. patent application No. 141784, filing date '88 1/11, now U.S. Pat. No. 4,814,659.

*Primary Examiner*—Andres Kashnikow
*Assistant Examiner*—Christopher G. Trainor
*Attorney, Agent, or Firm*—Oliff & Berridge

[57] ABSTRACT

A fuel injector comprising a piston actuated by a piezoelectric element. A pressure control chamber is formed between the piston and the top face of the needle and connected to a high pressure fuel source via a fuel passage having a restricted flow area. The pressure control chamber is filled with fuel under pressure. The rear face of the piston, which is positioned opposite to the pressure control chamber, is exposed to a high pressure fuel chamber filled with fuel under pressure. The driving force acting on the piston due to the pressure of fuel in the pressure control chamber is cancelled by the driving force acting on the piston due to the pressure of fuel in the high pressure fuel chamber.

20 Claims, 3 Drawing Sheets

FUEL INJECTOR FOR AN ENGINE

BACKGROUND OF THE INVENTION

1. Field of the Invention

The present invention relates to a fuel injector for an engine.

2. Description of the Related Art

In a known fuel injector, the opening and closing of the nozzle holes is controlled by one end of a needle, and a pressure control chamber is formed between the piston and the other end of the needle. The pressure control chamber is connected to a high pressure fuel source via a fuel passage having a restricted flow area, and the piston is actuated by the piezoelectric element. When the volume of the pressure control chamber is increased due to the movement of the piston, the needle opens the nozzle holes, and when the volume of the pressure control chamber is decreased due to the movement of the piston, the needle closes the nozzle holes (see Japanese Unexamined Patent Publication No. 59-206668).

In this fuel injector, the pressure control chamber is filled with fuel under a high pressure, and when the piezoelectric element is caused to contract and the piston accordingly moved to increase the volume of the pressure control chamber, the pressure of the fuel in the pressure control chamber temporarily becomes low. At this time, the needle opens the nozzle holes, and the pressure of the fuel in the pressure control chamber is increased to the initial high pressure. Conversely, when the piezoelectric element is caused to expand, and the piston accordingly moved to reduce the volume of the pressure control chamber, the pressure of the fuel in the pressure control chamber temporarily becomes high. At this time, the needle closes the nozzle holes, and the pressure of the fuel in the pressure control chamber is decreased to the initial high pressure. Consequently, in this fuel injector, the pressure control chamber is normally filled with fuel under a high pressure, and this high pressure acts continuously on the piezoelectric element via the piston.

Where, however, the fuel injector has a construction such that the pressure of fuel in the pressure control chamber acts on the piezoelectric element, when the pressure of fuel fed into the pressure control chamber via the fuel passage having a restricted flow area is changed, the load acting on the piezoelectric element is changed accordingly, and as a result, when electric power is supplied to the piezoelectric element, the amount of expansion of the piezoelectric element is changed in accordance with a change in the load acting on the piezoelectric element, and thus a problem arises in that it is difficult to precisely control the opening and closing of the needle.

SUMMARY OF THE INVENTION

An object of the present invention is to provide a fuel injector capable of obtaining a precise control of the opening and the closing of the needle.

According to the present invention, there is provided a fuel injector connected to a high pressure fuel source, comprising: a needle having one end which controls the opening operation of a nozzle hole and having another end opposite to the one end; a piston having one end and a rear face opposite to the one end of the piston, the other end of the needle and the one end of the piston defining a pressure control chamber therebetween; a fuel passage having a restricted flow area and connecting the pressure control chamber to the high pressure fuel source to feed fuel under pressure in the high pressure fuel source into the pressure control chamber; a high pressure fuel chamber to which the rear face of the piston is exposed, the high pressure fuel chamber being filled with fuel under pressure having a pressure which is substantially equal to that of the fuel under pressure in the pressure control chamber to urge the piston toward the pressure control chamber; and actuating means for actuating the piston to increase a volume of the pressure control chamber, to thereby cause the nozzle hole to be opened by the needle and to decrease the volume of the pressure control chamber, to thereby cause the nozzle hole to be closed by the needle.

The present invention may be more fully understood from the description of preferred embodiments of the invention set forth below, together with the accompanying drawings.

DESCRIPTION OF THE PREFERRED EMBODIMENTS

Figure 1:
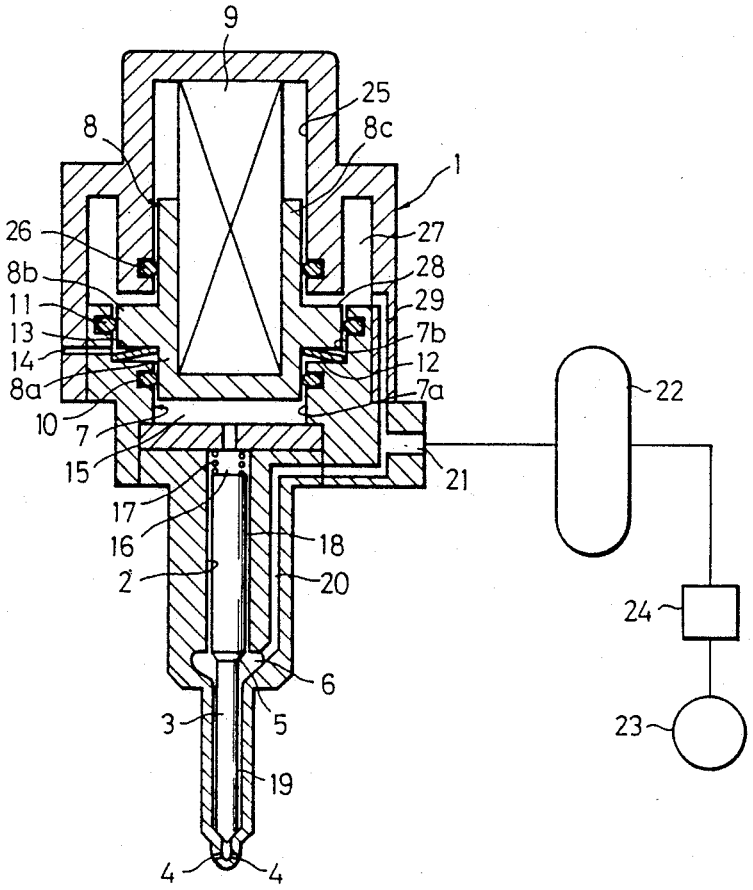
FIG. 1 is a cross-sectional side view of a first embodiment of the fuel injector.

FIG. 1 illustrates a first embodiment of a fuel injector. Referring to FIG. 1, reference numeral 1 designates a housing of the fuel injector, 2 a needle bore, 3 a needle inserted into the needle bore 2, 4 nozzle holes, 5 a pressure receiving face formed on the needle 3, 6 a needle pressure chamber formed around the pressure receiving face 5, 7 a cylinder, 8 a piston slidably inserted in the cylinder 7, and 9 a piezoelectric element for activating the piston 8. The cylinder 7 comprises a reduced diameter cylinder portion 7*a* and an increased diameter cylinder portion 7*b* which is arranged coaxially with the reduced diameter cylinder portion 7*a*. The piston 8 comprises a reduced diameter piston portion 8*a* slidably inserted in the reduced diameter cylinder portion 7*a*, and an increased diameter piston portion 8*b* slidably inserted in the increased diameter cylinder portion 7*b* and integrally formed with the reduced diameter piston portion 8*a*. A seal ring 10 is inserted between the reduced diameter cylinder portion 7*a* and the reduced diameter piston portion 8*a*, and another seal ring 11 is inserted between the increased diameter cylinder portion 7*b* and the increased diameter piston portion 8*b*. Further, a disc-shaped spring 12 is inserted between the step portion of the cylinder 7 and the step portion of the piston 8, to urge the piston 8 toward the piezoelectric element 9. A clearance formed between the cylinder 7 and the piston 8 and between the seal rings 10 and 11 is connected to a leakage fuel discharged port 14.

A pressure control chamber 15 defined by the reduced diameter piston portion 8*a* is formed in the reduced diameter cylinder portion 7*a*. This pressure control chamber 15 is connected to a pressure control chamber 16 defined by the top face of the needle 3 within the needle bore 2, and consequently, the pressure control chambers 15, 16 are formed between the piston 8 and the top face of the needle 3. A comparison spring 17 is arranged in the pressure control chamber 16 to continuously urge the needle 3 toward the nozzle holes 4, and the pressure control chamber 16 is connected to the needle pressure chamber 6 via an annular fuel passage 18 having a restricted flow area and formed between the needle 3 and the needle bore 2. The need pressure chamber 6 is connected on one hand to the nozzle holes 4 via an annular fuel passage 19 formed around the needle 3, and on the other hand, to a fuel inlet 21 via a fuel passage 20. The fuel inlet 21 is connected to a reservoir tank 22 storing fuel under a high pressure therein, and fuel under a high pressure discharged from a fuel pump 23 is fed into the reservoir tank 22 via a flow control valve 24.

A hollow sleeve 8*c* having a diameter which is smaller than the diameter of the increased diameter piston portion 8*b* is integrally formed on the increased diameter piston portion 8*b*, and a seal ring 26 is inserted between the sleeve 8*c* and a sleeve bore 25. An annular high pressure fuel chamber 27 is formed around the sleeve 25, and the rear face 28 of the increased diameter piston portion 8*b* is exposed to the high pressure fuel chamber 27. The high pressure fuel chamber 27 is connected to the fuel inlet 21 via a fuel passage 29.

Fuel under a high pressure fed into the fuel inlet 21 from the reservoir tank 22 is fed on one hand into the needle pressure chamber 6 via the fuel passage 20, and on the other hand, into the high pressure chamber 27 via the fuel passage 29. The fuel under a high pressure fed into the needle pressure chamber 6 is fed into the pressure control chambers 15, 16 via the fuel passage 18 having a restricted flow area, and thus the pressure control chambers 15, 16 are filed with fuel under a high pressure. In addition, the high pressure fuel chamber 27 is also filled with fuel under a high pressure, and consequently, where the contraction and expansion of the piezoelectric element 9 is not carried out, the pressure of the fuel in the high pressure fuel chamber 27 is equal to that in the pressure control chambers 15, 16. The pressure of the fuel in the high pressure fuel chamber 27 acts on the rear face 28 of the increased diameter piston portion 8*b*. The increased diameter piston portion 8*b* is formed so that the rear face 28 thereof has a surface area which is equal to or slightly smaller than the cross-sectional area of the reduced diameter piston portion 8*a*. Therefore, where the surface area of the rear face 28 of the increased diameter piston portion 8*b* is equal to the cross-sectional area of the reduced diameter piston portion 8*a*, the driving force due to the pressure of fuel fed from the fuel pump 23 does not act in any way on the piston 8, and thus the pressure of fuel fed from the fuel pump 23 does not act in any way on the piezoelectric element 9. Where the surface area of the rear face 28 of the increased diameter piston portion 8*b* is slightly smaller than the cross-sectional area of the reduced diameter piston portion 8*a*, the upward driving force acts on the piston 8 due to the pressure of fuel fed from the fuel pump 23, but this driving force is weak, and the load acting to contract the piezoelectric element 9 is low.

When electric charges in the piezoelectric element 9 are discharged, the piezoelectric element 9 contracts, and at this time, the piston 8 is moved upward due to the spring force of the disc-shaped spring 12. As a result, since the volume of the pressure control chambers 15, 16 is increased, the pressure of the fuel in the pressure control chambers 15, 16 becomes low, and when the pressure of the fuel in the pressure control chambers 15, 16 becomes low, the needle 3 is moved upward due to the pressure of fuel in the pressure receiving face 5 of the needle 3, and thus the fuel injection from the nozzle holes 4 is started. When the pressure of the fuel in the pressure control chambers 15, 16 becomes low, and the needle 3 is moved upward, the volume of the pressure control chambers 15, 16 is decreased, and further, the fuel under high pressure in the needle pressure chamber 6 is gradually fed into the pressure control chambers 15, 16 via the fuel passage 18 having a restricted flow area. As a result, although the pressure of the fuel in the pressure control chambers 15, 16 is increased, the spring force of the compression spring 17 and the flow area of the fuel passage 18 are determined such that the needle 3 remains open during the fuel injection time, and thus the fuel injection continues to be carried out.

When electric power is charged to the piezoelectric element 9, since the piezoelectric element 9 expands, the piston 8 is moved downward, and as a result, since the volume of the pressure control chambers 15, 16 is decreased, the pressure of the fuel in the pressure control chambers 15, 16 becomes high. When the pressure of the fuel in the pressure control chambers 15, 16 becomes high, the needle 3 is moved downward and closes the nozzle holes 4, and thus the fuel injection is stopped. Also, when the needle 3 is moved downward, the volume of the pressure control chambers 15, 16 is increased, and further, the fuel in the pressure control chambers 15, 16 is returned to the needle pressure chamber 6 via the fuel passage 18 having a restricted flow area. As a result, the pressure of the fuel in the pressure control chambers 15, 16 approaches the pressure of the fuel in the needle pressure chamber 6.

During the above-mentioned operation of the fuel injector, the driving force acting on the piston 8 from the pressure control chamber 15 side due to the pressure of the fuel fed from the fuel pump 23 is substantially cancelled by the driving force acting on the piston 8 from the high pressure fuel chamber 27 side due to the pressure of the fuel fed from the fuel pump 23. Consequently, even if the pressure of the fuel fed from the fuel pump 23 is changed, this change does not have a substantial influence on the piezoelectric element 9, and therefore, since this change does not cause a change in the amount of the expansion of the piezoelectric element 9, a precise control of the fuel injection can be obtained. In addition, the driving force due to the pressure of the fuel fed from the fuel pump 23 does not act on the piezoelectric element 9, or even if this driving force does act on the piezoelectric element 9, the force thereof is extremely weak. Consequently, an energy needed to expand the piezoelectric element 9 is reduced, and thus it is possible to minimize the size of the piezoelectric element 9 and reduce the consumption of electric power.

When the piezoelectric element 9 contracts, the piston 8 is moved upward due to the spring force of the disc-shaped spring 12, and therefore, the high pressure fuel chamber 27 must have a relatively large volume, or the fuel passage 29 must have a relatively large cross-sectional area so that, when the piston 8 is moved upward, the pressure of the fuel in the high pressure fuel chamber 27 is not increased to an extent such that the upward movement of the piston 8 is prevented.

Figure 2:
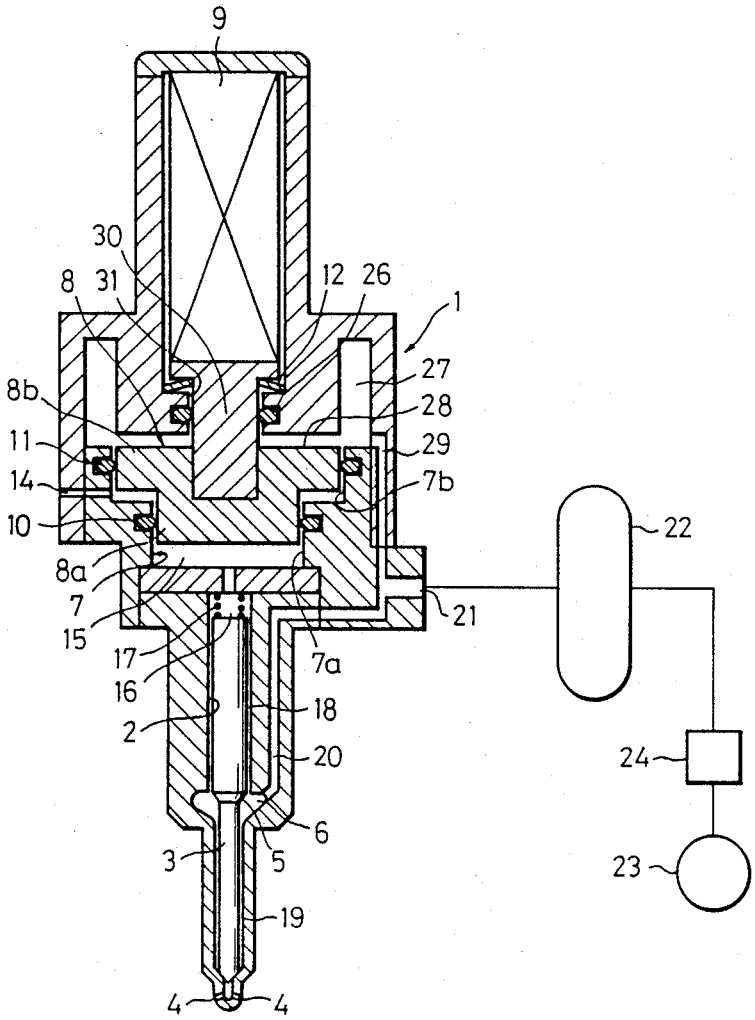
FIG. 2 is a cross-sectional side view of a second embodiment of the fuel injector.

FIG. 2 illustrates a second embodiment of the fuel injection. In this embodiment, similar components are indicated by the same reference numerals as used in FIG. 1.

In this embodiment, a rod 30 having a diameter which is smaller than the diameter of the piezoelectric element 9 is fixed to the piston 8, and the piston 8 is connected to the piezoelectric element 9 via the rod 30. The seal ring 26 is inserted between the rod 30 and a rod bore 31, and the disc-shaped spring 12 is inserted between the rod 30 and the housing 1. In this embodiment, since the diameter of the rod 30 can be reduced, a sufficient surface area of the rear face 28 of the increased diameter piston portion **8*b* can be obtained. But, also in this embodiment, the increased diameter piston portion 8*b* is formed so that the surface area of the rear face 28 thereof is equal to or smaller than the cross-sectional area of the reduced diameter piston portion 8*a***.

Figure 3:
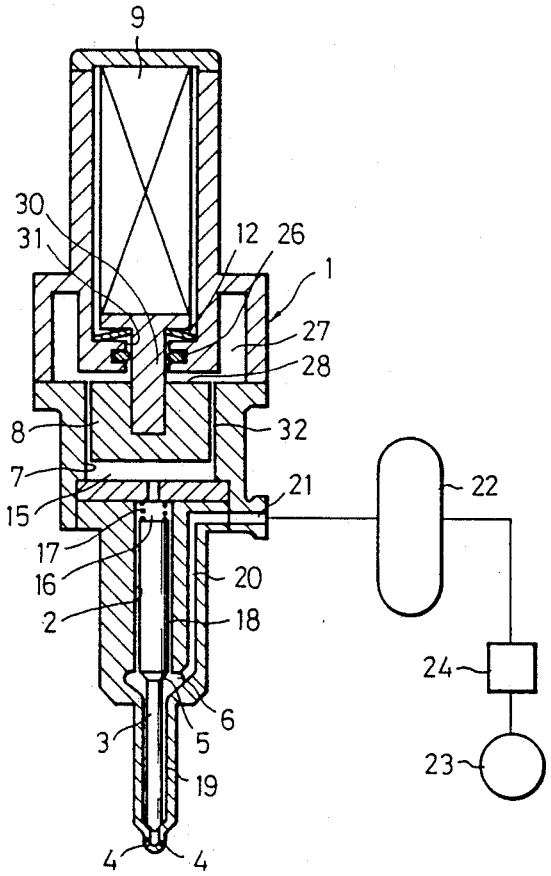
FIG. 3 is a cross-sectional side view of a third embodiment of the fuel injector.

FIG. 3 illustrates a third embodiment of the fuel injector. In this embodiment, similar components are indicated by the same reference numerals as used in FIG. 2. In this embodiment, the cylinder 7 has a cylindrical shape having a uniform cross-section over the entire length thereof, and the piston 8 has a cylindrical shape having a uniform cross-section over the entire length thereof. An annular fuel passage 32 having a restricted flow area is formed between the cylinder 7 and the piston 8, and the high pressure fuel chamber 27 is connected to the pressure control chamber 15 via the fuel passage 32 having a restricted flow area. The fuel under a high pressure in the needle pressure chamber 6 is fed into the pressure control chambers 15, 16 via the fuel passage 18 having a restricted flow area, and the fuel under a high pressure in the pressure control chamber 15 is fed into the high pressure fuel chamber 27 via the fuel passage 32 having a restricted flow area. Therefore, also in this embodiment, the pressure of the fuel in the high pressure fuel chamber 27 becomes equal to that in the pressure control chambers 15, 16. This embodiment has an advantage in that the construction is simplified, compared with the constructions illustrated in FIGS. 1 and 2. But, in this embodiment, it is impossible to make the surface area of the rear face 28 of the piston 8 equal to the cross-sectional area of the piston 8. Nevertheless, since the surface area of the rear face 28 of the piston 8 can be formed to be very close to the cross-section area of the piston 8, by reducing the diameter of the rod 30, it is possible to considerably decrease the load acting on the piezoelectric element 9.

According to the present invention, the driving force due to the pressure of fuel does not act on the piezoelectric element, or even if the driving force due to the pressure of fuel does act on the piezoelectric element, this force is extremely small. As a result, it is possible to improve the durability of the piezoelectric element, and further, since a change in the pressure of fuel does not have a substantial influence on the amount of expansion of the piezoelectric element, it is possible to carry out a precise control of the fuel injection.

While the invention has been described by reference to specific embodiments chosen for purposes of illustration, it should be apparent that numerous modifications could be made thereto by those skilled in the art without departing from the basic concept and scope of the invention.

We claim:

1. A fuel injector connected to a high pressure fuel source, comprising:

a needle having one end which controls the opening operation of a nozzle hole and having another end opposite to said one end;

a piston having one end and a rear face opposite to said one end of said piston, the other end of said needle and the one end of said piston defining a pressure control chamber therebetween;

a fuel passage having a restricted flow area and connecting said pressure control chamber to the high pressure fuel source to feed fuel under pressure in the high pressure fuel source into said pressure control chamber;

a high pressure fuel chamber to which the rear face of said piston is exposed, said high pressure fuel chamber being filled with fuel under pressure and having a pressure which is substantially equal to that of the fuel under pressure in said pressure control chamber to urge said piston toward said pressure control chamber; and actuating means for actuating said piston to increase a volume of said pressure control chamber, to thereby cause said nozzle hole to be opened by said needle and to decrease the volume of said pressure control chamber, to thereby cause said nozzle hole to be closed by said needle, wherein said piston is slidably inserted in a cylinder, and a clearance between said piston and said cylinder is sealed, said high pressure fuel chamber being connected to the high pressure fuel source;

said cylinder comprising a reduced diameter cylinder portion and an increased diameter cylinder portion, and said piston comprising a reduced diameter piston portion slidably inserted in said reduced diameter cylinder portion, and an increased diameter piston portion slidably inserted in said increased diameter cylinder portion, said reduced diameter piston portion defining said pressure control chamber, said increased diameter piston portion forming said rear face thereon.

2. A fuel injector according to claim 1, wherein said needle is slidably inserted in a needle bore and has a pressure receiving face formed thereof, and said needle bore has a needle pressure chamber formed around said pressure receiving face and connected to the high pressure fuel source, said fuel passage being formed between said needle and said needle bore and extending between said pressure control chamber and said needle pressure chamber.

3. A fuel injector according to claim 1, wherein said needle is slidably inserted in a needle bore, and a compression spring is arranged in said needle bore to urge said needle toward said nozzle hole.

4. A fuel injector according to claim 1, wherein a seal ring is inserted between said reduced diameter cylinder portion and said reduced diameter piston portion, and a seal ring is inserted between said increased diameter cylinder portion and said increased diameter piston portion.

5. A fuel injector according to claim 4, wherein a clearance between said cylinder and said piston and between said seal rings is connected to a leakage fuel discharge port.

6. A fuel injector according to claim 1, wherein said piston has a step portion between said reduced diameter piston portion and said increased diameter piston portion, and said cylinder has a step portion between said reduced diameter cylinder portion and said increased diameter cylinder portion, a disc-shaped spring being inserted between the step portion of said piston and the step portion of said cylinder to urge said piston toward said high pressure fuel chamber.

7. A fuel injector according to claim 1, wherein a spring is arranged between said piston and said cylinder to urge said piston toward said high pressure fuel chamber.

8. A fuel injector according to claim 1, wherein said piston is slidably inserted in a cylinder, and a clearance between said piston and said cylinder forms another fuel passage having a restricted flow area and extending between said high pressure fuel chamber and said pressure control chamber to connect said high pressure fuel chamber to said pressure control chamber.

9. A fuel injector according to claim 1, wherein said piston has a projection projecting from said rear face and slidably inserted in a projection bore, said projection having a diameter which is smaller than a diameter of said rear face.

10. A fuel injector according to claim 9, wherein a surface area of said rear face other than said projection is substantially equal to a surface area of said one end of said piston.

11. A fuel injector according to claim 9, wherein a surface area of said rear face other than said projection is smaller than a surface area of said one end of said piston.

12. A fuel injector according to claim 9, wherein said projection is formed by a hollow sleeve, and said actuating means is arranged in said hollow sleeve.

13. A fuel injector according to claim 9, wherein said projection is formed by a rod, and said actuating means is connected to said piston via said rod.

14. A fuel injector according to claim 9, wherein a seal ring is inserted between said projection and said projection bore.

15. A fuel injector according to claim 9, wherein a spring is inserted between said projection and said projection bore to urge said piston toward said high pressure fuel chamber.

16. A fuel injector according to claim 9, wherein said high pressure fuel chamber has an annular shape extending around said projection.

17. A fuel injector according to claim 1, wherein said actuating means comprises a piezoelectric element.

18. A fuel injector connected to a high pressure fuel source, comprising:

a needle having one end which controls the opening operation of a nozzle hole and having another end opposite to said one end;

a piston having one end and a rear face opposite to said one end of said piston, the other end of said needle and the one end of said piston defining a pressure control chamber therebetween;

a fuel passage having a restricted flow area and connecting said pressure control chamber to the high pressure fuel source to feed fuel under pressure in the high pressure fuel source into said pressure control chamber;

a high pressure fuel chamber to which the rear face of said piston is exposed, said high pressure fuel chamber being filled with fuel under pressure and having a pressure which is substantially equal to that of the fuel under pressure in said pressure control chamber to urge said piston toward said pressure control chamber; and actuating means for actuating said piston to increase a volume of said pressure control chamber, to thereby cause said nozzle hole to be opened by said needle and to decrease the volume of said pressure control chamber, to thereby cause said nozzle hole to be closed by said needle, wherein said piston is slidably inserted in a cylinder, and a clearance between said piston and said cylinder forms another fuel passage having a restricted flow area and extending between said high pressure fuel chamber and said pressure control chamber such that said high pressure fuel chamber communicates only with said pressure control chamber.

19. A fuel injector according to claim 18, wherein said high pressure fuel chamber comprises a portion facing the rear face of the piston, and an annular portion formed around the rear face of the piston.

20. A fuel injector according to claim 8, wherein said piston has a cylindrical shape having a uniform cross-section over the entire length thereof, and said cylinder has a cylindrical shape having a uniform cross-section over the entire length thereof.

* * * * *